US009001109B2

(12) United States Patent
Li et al.

(10) Patent No.: US 9,001,109 B2
(45) Date of Patent: Apr. 7, 2015

(54) LED BACKLIGHT DRIVING CIRCUIT, BACKLIGHT MODULE, AND LCD DEVICE

(75) Inventors: Fei Li, Shenzhen (CN); Xinming Gao, Shenzhen (CN); Xiang Yang, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 300 days.

(21) Appl. No.: 13/583,928

(22) PCT Filed: Jul. 9, 2012

(86) PCT No.: PCT/CN2012/078366

§ 371 (c)(1),
(2), (4) Date: Sep. 11, 2012

(87) PCT Pub. No.: WO2014/005340

PCT Pub. Date: Jan. 9, 2014

(65) Prior Publication Data

US 2014/0009455 A1 Jan. 9, 2014

(51) Int. Cl.

| | |
|---|---|
| ***G09G 5/00*** | (2006.01) |
| ***G09G 3/34*** | (2006.01) |
| ***H05B 33/08*** | (2006.01) |

(52) U.S. Cl.

CPC ..... *G09G 3/3406* (2013.01); *G09G 2320/041* (2013.01); *G09G 2320/064* (2013.01); *G09G 2330/08* (2013.01); *H05B 33/0827* (2013.01)

(58) Field of Classification Search

CPC ..... H05B 33/0851; H05B 33/0848; F21Y 101/02; F21Y 2103/003; G02F 1/1336; H01R 13/7175; H03K 17/0826; H03K 17/60; H04B 10/802

USPC ..... 345/102, 212; 315/185 R, 192, 219, 315/294, 307, 308; 361/7, 8, 101

See application file for complete search history.

(56) References Cited

U.S. PATENT DOCUMENTS

| | | | | |
|---|---|---|---|---|
| 5,825,136 | A * | 10/1998 | Rudolph | 315/291 |
| 8,179,704 | B2 * | 5/2012 | Wang et al. | 363/52 |
| 8,599,119 | B2 * | 12/2013 | Hosogi et al. | 345/82 |
| 2011/0309758 | A1 | 12/2011 | Yu et al. | |
| 2012/0112647 | A1 * | 5/2012 | Dinc | 315/186 |
| 2012/0187858 | A1 * | 7/2012 | Omi et al. | 315/224 |

FOREIGN PATENT DOCUMENTS

| | | | |
|---|---|---|---|
| CN | 101527120 | A | 9/2009 |
| CN | 101916548 | A | 12/2010 |
| CN | 101916550 | A | 12/2010 |
| CN | 102123536 | A | 7/2011 |
| CN | 102202444 | A | 9/2011 |
| JP | 2006222377 | A | 8/2006 |
| JP | 4199202 | B2 | 12/2008 |
| JP | 2010212369 | A | 9/2010 |
| TW | M391250 | U1 | 10/2010 |

OTHER PUBLICATIONS

Gao Wang, the International Searching Authority written comments, Apr. 2013, CN.

* cited by examiner

*Primary Examiner* — Kent Chang
*Assistant Examiner* — Gerald Oliver
(74) *Attorney, Agent, or Firm* — IPro, Inc.; Na Xu

(57) ABSTRACT

The present disclosure discloses a light emitting diode (LED) backlight driving circuit, a backlight module, and a liquid crystal display (LCD) device. The LED backlight driving circuit includes an LED lightbars. An output end of the LED lightbar is connected with a control integrated circuit (IC) in series, and is also connected with a shunt controllable switch. The shunt controllable switch is switched on when a voltage of the output end of the LED lightbar exceeds a preset value and is switched off when the voltage is less than the preset value. In the present disclosure, because a shunt controllable switch is connected in parallel in the control IC, when the LED lightbars are short-circuited, the shunt controllable switch is switched on, a part of current flows towards the shunt controllable switch, and the burden of the control IC is alleviated. Thus, the temperature of the control IC is reduced.

15 Claims, 1 Drawing Sheet

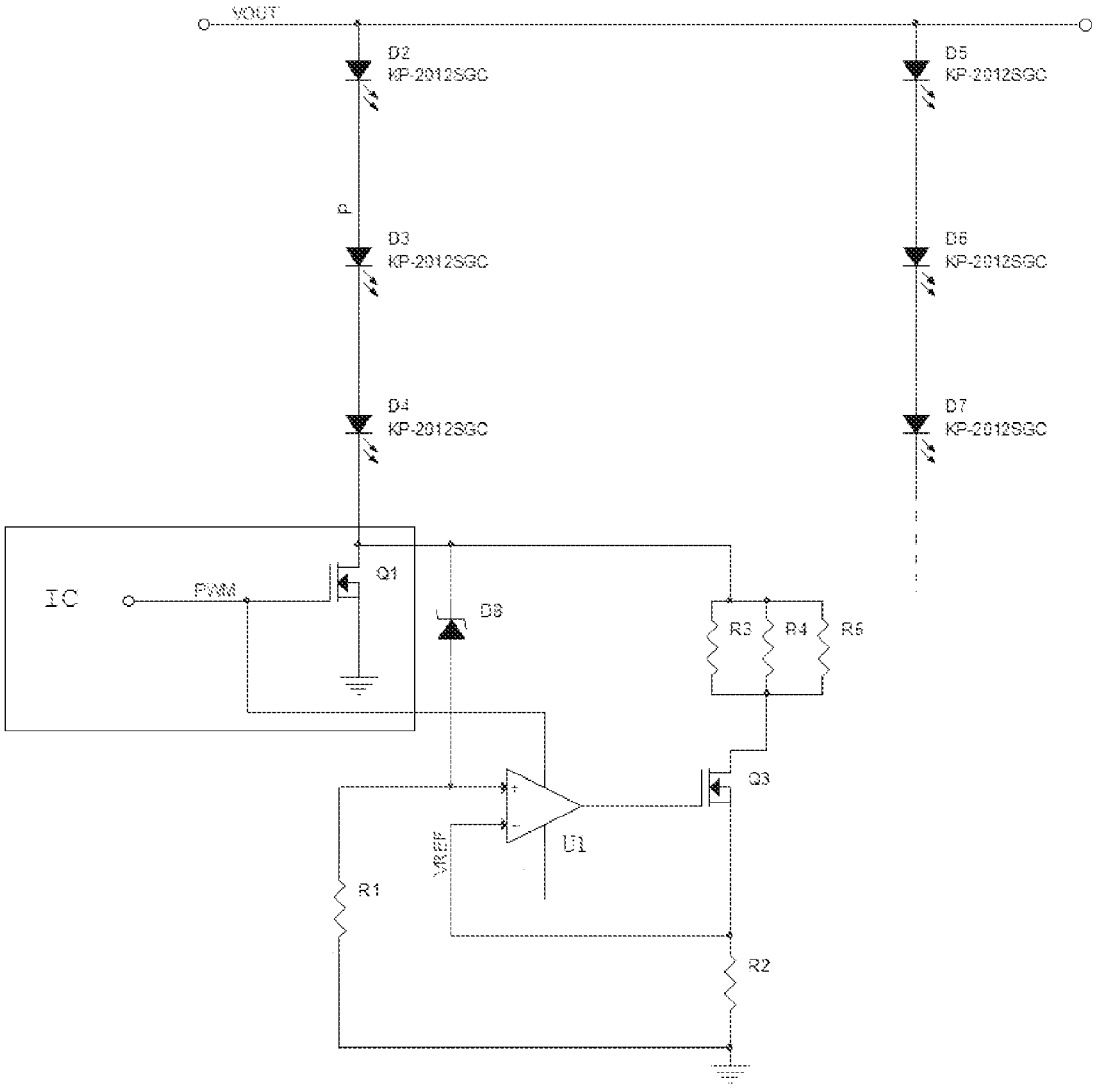
VOUT
D2
KP-2012SGC
D3
KP-2012SGC
D4
KP-2012SGC
D5
KP-2012SGC
D6
KP-2012SGC
D7
KP-2012SGC
IC
PWM
Q1
D8
R3
R4
R5
Q3
U1
VREF
R1
R2

LED BACKLIGHT DRIVING CIRCUIT, BACKLIGHT MODULE, AND LCD DEVICE

TECHNICAL FIELD

The present disclosure relates to the field of liquid crystal displays (LCDs), and more particularly to a light emitting diode (LED) backlight driving circuit, a backlight module, and an LCD device.

BACKGROUND

In a typical liquid crystal display (LCD) device, light emitting diodes (LEDs) are adopted as backlight sources. Specifically, a plurality of LEDs are connected in series to form an LED lightbar; for a large LCD device, a plurality of LED lightbars shall be connected in parallel for use; the LED lightbar is connected in series with a dimming MOS for dimming When the LED lightbars are short-circuited, or two or three LEDs in one LED lightbar are short-circuited, the voltage difference among the LEDs is applied to the dimming MOS in a control integrated circuit (IC), causing heating of the control IC. Thus, generally, when the voltage difference among the LED strings is overhigh, the strings will be switched off for preventing the control IC from heating. However, if the LEDs are switched off, display brightness is inevitably reduced and display quality is affected.

SUMMARY

In view of the above-described problems, the aim of the present disclosure is to provide a light emitting diode (LED) backlight driving circuit, a backlight module, and a liquid crystal display (LCD) device capable of reducing integrated circuit (IC) temperature when LEDs are short-circuited.

The aim of the present disclosure is achieved by the following technical schemes:

An LED backlight driving circuit comprises an LED lightbar; an output end of the LED lightbar is connected with a control IC in series, and is also connected with a shunt controllable switch; the shunt controllable switch is switched on when a voltage of the output end of the LED lightbar exceeds a preset value and is switched off when the voltage is less than the preset value.

In one example, a control end of the shunt controllable switch is connected with an operational amplifier (OP) module; a feedback resistor is connected in series between the output end of the shunt controllable switch and a power grounding terminal; a first input end of the OP module is coupled to the output end of the LED lightbar; a second input end of the OP module is coupled between the shunt controllable switch and the feedback resistor. This is an example of a control circuit of the shunt controllable switch. The shunt controllable switch is controlled by comparing a voltage difference between the feedback resistor end and the output end of the LED lightbar. On one hand, the shunt controllable switch can be switched on in time when the output end of the LED lightbar has an overhigh voltage. On the other hand, when the shunt controllable switch has an overhigh current, the shunt controllable switch is switched off for preventing the shunt controllable switch from being overheated and damaged by burn.

In one example, the LED backlight driving circuit further comprises a diode; an anode of the diode is coupled to the first input end of the OP module, and a cathode of the diode is coupled to the output end of the LED lightbar. A voltage collecting resistor is connected in series between the first input end of the OP module and the power grounding terminal. When the voltage of the output end of the LED lightbar exceeds the preset value, the diode is reversely switched on, the OP module is put into service, and the shunt controllable switch is switched on. Thus, the misoperation of the OP module when the voltage is normal can be effectively avoided.

In one example, a voltage dividing resistor is connected in series between the output end of the LED lightbar and the shunt controllable switch. The voltage dividing resistor can share a part of voltage of a branch circuit of the shunt controllable switch and can perform the function of dissipating heat.

In one example, there is a plurality of voltage dividing resistors. The voltage dividing resistors are connected in parallel. The plurality of voltage dividing resistors are connected in parallel, and thus the total resistance of the voltage dividing resistors is reduced. Under the condition that the voltage is definite, the current flowing through the voltage dividing resistors is increased, and the heat productivity of the current is increased. Thus, the heat dissipation capacity of the voltage dividing resistors can be enhanced.

In one example, there is a plurality of LED lightbars. The output ends of the LED lightbars are individually connected with the shunt controllable switch; or, the output ends of the LED lightbars are connected to the same shunt controllable switch. Because it is rare that a plurality of LED lightbars are simultaneously short-circuited, the shunt controllable switch can be shared, thereby saving cost. Optionally, to enhance the system reliability, it is also feasible that the LED lightbar individually uses a group of controllable switches.

In one example, the control IC comprises a dimming controllable switch; the dimming controllable switch and the LED lightbar are connected in series. This is an inner circuit structure of the control IC.

In one example, a control end of the shunt controllable switch is connected with an OP module, and an output end of the shunt controllable switch is connected with a feedback resistor in series. A first input end of the OP module is coupled with the output end of the LED lightbar through a diode. An anode of the diode is coupled to the first input end of the OP module, and a cathode of the diode is coupled to the output end of the LED lightbar. A voltage collecting resistor is also connected in series between the first input end of the OP module and a power grounding terminal. A voltage dividing resistor is connected in series between the output end of the LED lightbar and the shunt controllable switch. There are a plurality of voltage dividing resistors, and the voltage dividing resistors are connected in parallel. This is a specific LED backlight driver circuit.

A backlight module comprises the LED backlight driving circuit mentioned above.

An LCD device comprises the backlight module mentioned above.

In the present disclosure, because a shunt controllable switch is connected in parallel in the control IC, when the LED lightbars are short-circuited, the shunt controllable switch is switched on, a part of current flows towards the shunt controllable switch, and the burden of the control IC is alleviated. Thus, the temperature of the control IC can be reduced.

BRIEF DESCRIPTION OF FIGURES

FIG. 1 is a schematic diagram of an example of the present disclosure.

DETAILED DESCRIPTION

A liquid crystal display (LCD) device comprises an LCD panel and a backlight module. The backlight module comprises a light emitting diode (LED) backlight driving circuit. The LED backlight driving circuit of the present disclosure comprises an LED lightbar. An output end of the LED lightbar is connected with a control IC in series, and is also connected with a shunt controllable switch. The shunt controllable switch is switched on when the voltage of the output end of the LED lightbar exceeds a preset value and is switched off when the voltage is less than the preset value.

In the present disclosure, because the shunt controllable switch is connected in parallel in the control IC, when the LED lightbars are short-circuited, the shunt controllable switch is switched on, a part of current flows towards the shunt controllable switch, and the burden of the control IC is alleviated. Thus, the temperature of the control IC can be reduced. The present disclosure will be further described in accordance with the figures and preferred examples.

FIG. 1 shows an optimal example of the present disclosure. The power input end VOUT is connected with a plurality of LED lightbars in parallel. The LED lightbar is connected with the control IC in series. A dimming controllable switch Q1 is arranged in the control IC. The dimming controllable switch Q1 is connected to the output end of the LED lightbar.

The LED backlight driving circuit of the example further comprises a shunt controllable switch Q3, voltage dividing resistors (R3/R4/R5), a feedback resistor R2, a voltage collecting resistor R1, a diode D8, and an operational amplifier (OP) module U1. The input end of the shunt controllable switch is coupled to the output end of the LED lightbar through the voltage dividing resistors. The output end of the shunt controllable switch is coupled to the power grounding terminal through the feedback resistor. The control end of the shunt controllable switch is coupled to the OP module. On one hand, a first input end of the OP module is coupled to the anode of the diode. On the other hand, the first input end is coupled to the power grounding terminal through the voltage collecting resistor R1. The cathode of the diode is coupled to the output end of the LED lightbar. A second input end of the OP module is coupled between the shunt controllable switch and the feedback resistor.

When the voltage of the output end of the LED lightbar exceeds the preset value, the diode D8 is reversely switched on, the OP module U1 is put into service, and the shunt controllable switch Q3 is switched on. Thus, the misoperation of the OP module when the voltage is normal can be effectively avoided. After the shunt controllable switch Q3 is switched on, the voltage dividing resistor can share a part of voltage of a branch circuit of the shunt controllable switch and can perform the function of dissipating heat. There is a plurality of voltage dividing resistors, and the voltage dividing resistors are connected in parallel. The plurality of resistors are connected in parallel, and thus the total resistance of the voltage dividing resistors is reduced. Under the condition that the voltage is definite, the current flowing through the voltage dividing resistors is increased, and the heat productivity of the current is increased. Thus, the heat dissipation capacity of the voltage dividing resistors can be enhanced.

The OP module U1 controls the shunt controllable switch Q3 by comparing a voltage difference between the feedback resistor R2 end and the output end of the LED lightbar. On one hand, the shunt controllable switch can be switched on in time when the output end of the LED lightbar has an overhigh voltage. On the other hand, when the shunt controllable switch has an overhigh current, the shunt controllable switch is switched off for preventing the shunt controllable switch from being overheated and damaged by burn.

There is a plurality of LED lightbars in the example. The output ends of the LED lightbars are individually connected with a shunt controllable switch. Because it is rare that a plurality of LED lightbars are simultaneously short-circuited, the shunt controllable switch can be shared. Optionally, to enhance the system reliability, it is also feasible that the output ends of the LED lightbar are connected to the same shunt controllable switch.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A light emitting diode (LED) backlight driving circuit, comprising:

a light emitting diode (LED) lightbar;

wherein an output end of the light emitting diode (LED) lightbar is connected with a control integrated circuit (IC) in series, and is also connected with a shunt controllable switch; and wherein the shunt controllable switch is switched on when a voltage of the output end of the light emitting diode (LED) lightbar exceeds a preset value and is switched off when the voltage is less than the preset value; and wherein a control end of the shunt controllable switch is connected with an operational amplifier (OP) module; a feedback resistor is connected in series between an output end of the shunt controllable switch and a power grounding terminal; a first input end of the OP module is coupled to the output end of the LED lightbar; and a second input end of the OP module is coupled between the shunt controllable switch and the feedback resistor.

2. The LED backlight driving circuit of Claim 1, wherein the LED backlight driving circuit further comprises a diode; an anode of the diode is coupled to the first input end of the OP module, and a cathode of the diode is coupled to the output end of the LED lightbar; and a voltage collecting resistor is connected in series between the first input end of the OP module and the power grounding terminal.

3. The LED backlight driving circuit of claim 1, wherein a voltage dividing resistor is connected in series between the output end of the LED lightbar and the shunt controllable switch.

4. The LED backlight driving circuit of claim 3, wherein there are a plurality of the voltage dividing resistors; and the voltage dividing resistors are connected in parallel.

5. The LED backlight driving circuit of claim 1, wherein there is a plurality of LED lightbars; the output ends of the LED lightbars are individually connected with the shunt controllable switch; or, the output ends of the LED lightbars are connected to the same shunt controllable switch.

6. The LED backlight driving circuit of claim 1, wherein the control IC comprises a dimming controllable switch; and the dimming controllable switch is connected with the LED lightbar in series.

7. The LED backlight driving circuit of claim 1, wherein a control end of the shunt controllable switch is connected with an OP module; an output end of the shunt controllable switch is connected with a feedback resistor in series; a first input end of the OP module is coupled with the output end of the LED lightbar through a diode; an anode of the diode is coupled to the first input end of the OP module, and a cathode of the diode is coupled to the output end of the LED lightbar; a voltage collecting resistor is also connected in series between the first input end of the OP module and a power grounding terminal; a voltage dividing resistor is connected in series between the output end of the LED lightbar and the shunt controllable switch; there are a plurality of the voltage dividing resistors; and the voltage dividing resistors are connected in parallel.

8. A backlight module, comprising:

a light emitting diode (LED) backlight driving circuit comprising a light emitting diode (LED) lightbar;

wherein an output end of the light emitting diode (LED) lightbar is connected with a control integrated circuit (IC) in series, and is also connected with a shunt controllable switch;

wherein the shunt controllable switch is switched on when a voltage of the output end of the light emitting diode (LED) lightbar exceeds a preset value and is switched off when the voltage is less than the preset value; and wherein a control end of the shunt controllable switch is connected with an OP module; a feedback resistor is connected in series between an output end of the shunt controllable switch and a power grounding terminal; a first input end of the OP module is coupled to the output end of the LED lightbar; and a second input end of the OP module is coupled between the shunt controllable switch and the feedback resistor.

9. The backlight module of claim 8, wherein the LED backlight driving circuit further comprises a diode; an anode of the diode is coupled to the first input end of the OP module, and a cathode of the diode is coupled to the output end of the LED lightbar; and a voltage collecting resistor is also connected in series between the first input end of the OP module and the power grounding terminal.

10. The backlight module of claim 8, wherein a voltage dividing resistor is connected in series between the output end of the LED lightbar and the shunt controllable switch.

11. The backlight module of claim 10, wherein there are a plurality of the voltage dividing resistors; and the voltage dividing resistors are connected in parallel.

12. The backlight module of claim 8, wherein there are a plurality of the LED lightbars; the output ends of the LED lightbars are individually connected with the shunt controllable switch; or, the output ends of the LED lightbars are connected to the same shunt controllable switch.

13. The backlight module of claim 8, wherein the control IC comprises a dimming controllable switch; and the dimming controllable switch is connected with the LED lightbars in series.

14. The backlight module of claim 8, wherein a control end of the shunt controllable switch is connected with an OP module; an output end of the shunt controllable switch is connected with a feedback resistor in series; a first input end of the OP module is coupled with the output end of the LED lightbar through a diode; an anode of the diode is coupled to the first input end of the OP module, and a cathode of the diode is coupled to the output end of the LED lightbar; a voltage collecting resistor is also connected in series between the first input end of the OP module and a power grounding terminal; a voltage dividing resistor is connected in series between the output end of the LED lightbar and the shunt controllable switch; there are a plurality of the voltage dividing resistors; and the voltage dividing resistors are connected in parallel.

15. A liquid crystal display (LCD) device, comprising:

a backlight module comprising a light emitting diode (LED) backlight driving circuit comprising a light emitting diode (LED) lightbar; wherein an output end of the light emitting diode (LED) lightbar is connected with a control integrated circuit (IC) in series, and is also connected with a shunt controllable switch; wherein the shunt controllable switch is switched on when a voltage of the output end of the light emitting diode (LED) lightbar exceeds a preset value and is switched off when the voltage is less than the preset value; wherein a control end of the shunt controllable switch is connected with an OP module; an output end of the shunt controllable switch is connected with a feedback resistor in series; a first input end of the OP module is coupled with the output end of the LED lightbar through a diode; an anode of the diode is coupled to the first input end of the OP module, and a cathode of the diode is coupled to the output end of the LED lightbar; a voltage collecting resistor is also connected in series between the first input end of the OP module and a power grounding terminal; a voltage dividing resistor is connected in series between the output end of the LED lightbar and the shunt controllable switch; there are a plurality of the voltage dividing resistors; and the voltage dividing resistors are connected in parallel.

* * * * *